US008936498B1

(12) United States Patent
Lee

(10) Patent No.: US 8,936,498 B1
(45) Date of Patent: Jan. 20, 2015

(54) TELESCOPING TROLLING MOTOR

(71) Applicant: Bruce Lee, Rappahannock Academy, VA (US)

(72) Inventor: Bruce Lee, Rappahannock Academy, VA (US)

( * ) Notice: Subject to any disclaimer, the term of this patent is extended or adjusted under 35 U.S.C. 154(b) by 0 days.

(21) Appl. No.: 13/987,400

(22) Filed: Jul. 23, 2013

(51) Int. Cl.
*B63H 21/17* (2006.01)
*B63H 20/00* (2006.01)

(52) U.S. Cl.
CPC ..... *B63H 20/007* (2013.01); *B63H 21/17* (2013.01)
USPC ..... 440/6; 440/62

(58) Field of Classification Search
USPC ..... 440/62, 6
IPC ..... B63H 20/007
See application file for complete search history.

(56) References Cited

U.S. PATENT DOCUMENTS 7,163,427 B1 * 1/2007 Lee ..... 440/6
2001/0029133 A1 * 10/2001 Breems ..... 440/6

* cited by examiner

*Primary Examiner* — Stephen Avila
(74) *Attorney, Agent, or Firm* — Thomas J. Wallen, P.E., Attorney at Law, L.L.C.; Eugene H. Eickholt

(57) ABSTRACT

An improvement in telescoping electric trolling motors is disclosed. The trolling motor has a telescoping shaft that changes the depth of the electric motor, and therefore the prop of the trolling motor. A cable is used to raise and lower the electric motor and telescope the shaft. The same cable is used to pivot the trolling motor into a storage position on the deck of the boat.

9 Claims, 7 Drawing Sheets

TELESCOPING TROLLING MOTOR

FIELD OF THE INVENTION

The present invention is directed to trolling motors, in particular, a bow trolling motor having an extendable/retractable or telescoping shaft.

BACKGROUND OF THE INVENTION

The present invention is directed to a trolling motor of the type that includes a telescoping shaft, of the type disclosed in applicant's U.S. Pat. No. 7,163,427, issued to Bruce Lee, which disclosure is fully and expressly incorporated herein by reference.

The trolling motor according to the present invention includes a mounting bracket that connects the trolling motor to the boat. A drive unit, which includes a telescoping shaft, is pivotally connected to the mounting bracket. The mounting bracket, for example, can include a mounting plate configured to be secured to the boat (e.g. upper surface of deck). The trolling motor according to the present invention includes a shaft that is extendable/retractable or telescoping to change the length of the shaft. The mounting bracket facilitates pivoting of the trolling motor back and forth between the substantially horizontal non-operating resting or stowed position to the substantially vertical operating position. The trolling motor according to the present invention is configured so that the drive unit is retracted to a compacted configuration when the trolling motor is being stowed. Further, when the drive unit is in fully vertical operating position, the depth of the propeller of the drive unit can be raised or lowered by telescoping or collapsing the shaft. Applicant's U.S. Pat. No. 7,163,427 fully teaches the mechanical retraction mechanism which includes the mounting bracket of the instant trolling motor.

Applicant herein discloses an improvement over prior art telescoping trolling motor devices. According to the instant disclosure, the shaft can be telescoped or extended by the operator manually through a cable and cable locking device. In the preferred embodiment, the cable is a rope where the rope has knot like sections of increased rope diameter. In another embodiment a cable locking device locks the sections of decreased diameter that intercede between the rope sections of increased diameter. In other embodiments, a cable locking device locks a smooth cable of uniform diameter.

SUMMARY OF THE INVENTION

The present invention is directed to an improved telescoping trolling motor, in particular an improved bow trolling motor. Usually the trolling motor is mounted to the deck of the boat at the bow. However, it is expressly understood that the trolling motor of the present invention may be secured to the boat in any position along the boat, i.e. bow, stern, or along the side of the boat. The trolling motor includes the combination of a drive head, a telescoping shaft, and an electric motor with a prop and keel. The trolling motor is secured to the boat with a mounting bracket. Preferably, the drive unit is pivotally connected to the mounting bracket.

The mounting bracket includes two mounting plates; a first mounting plate is fastened to the boat. The first mounting plate is provided with through holes for accommodating fasteners (e.g. screws) for securely attaching the mounting plate, usually on top of the front deck at or adjacent the bow of the boat. A second mounting plate is pivotally connected to the trolling motor. Details of the mounting bracket and plates are found in applicant's U.S. Pat. No. 7,163,427.

The trolling motor includes an upper drive head, a telescoping shaft, and a lower electric motor and prop. The telescoping shaft connects the drive head to the electric motor.

The trolling motor is preferably mounted or installed at or adjacent to the bow of the boat, in particular on the upper deck of the boat. The trolling motor is configured to be pivoted from a substantially horizontal resting or stowed position on top of the deck at the bow of the boat to a substantially vertical operating position for propelling the boat.

The mounting bracket connects to the telescoping shaft. Preferably, the shaft is pivotally connected to the mounting bracket. The mounting bracket includes a mounting plate configured to be secured to the boat usually on the upper surface of the deck. The extendable/retractable or telescoping shaft changes length to facilitate lifting or lower and pivoting of the trolling motor back and forth between the substantially horizontal non-operating resting or stowed position to the substantially vertical operating position. Specifically, the trolling motor according to the present invention is configured so that the trolling motor can be compacted for stowage manually, by the operator simply by pulling a cord. Alternately the operator can raise or lower the electric motor and prop while the trolling motor is in operation, thereby changing the depth of the prop, by pulling the same cord.

The retracted mode of the shaft greatly facilitates the ease and convenience of a user pivoting the drive unit between non-operating position and operating position. Further, the retracted mode of the shaft significantly decreases the stowage space required on top of the deck for the trolling motor (i.e. retracted compact mode of the shaft significantly interferes with less user operating space when the user is moving about the deck of the boat). Further, because the shaft telescopes, the drive unit can sit directly on top of the mounting bracket, decreasing the space taken above the deck of the boat by the trolling motor.

According to the present invention, the shaft is moved from a fully retracted position to a fully extended position, or from a fully extended to a fully compacted position. For example, the drive unit includes a manual device or manual actuating device, in particular a cable to manually extend or retract the shaft. Types of cables contemplated include the known equivalents of ropes, cords, lanyards, chains, or the like. The preferred manual actuating device is a pull cord to move the shaft between the extended position and retracted position, or from the retracted position to the extended position.

The trolling motor according to the present invention also includes a control unit for controlling the steering, power on/off to the drive unit, and the level of power to the drive unit. Preferably, the control unit is a foot pedal control unit connected to the drive unit by a control cable. The control units are disclosed in applicant's prior U.S. Pat. No. 7,163,427, which control units are expressly and fully incorporated herein.

Specifically, a trolling motor comprising a drive unit that includes a drive head, an electric motor with prop, and a telescoping shaft is disclosed. The shaft includes an upper, outer shaft and a lower, inner shaft wherein the inner shaft is slidingly nested within the outer shaft. The telescoping shaft is interposed between the drive head and the electric motor. The combination further includes a cable attached to one end of a rod and where an opposite end of the rod attaches to the electric motor, such that pulling the cable raises the electric motor and collapses the shaft, and such that releasing the cable lowers the electric motor and extends the shaft. An electric cable extends through the shaft and drive head, and is adapted to carry electric current to the electric motor.

A rope cable is adapted to extend or retract the telescoping shaft with a locking mechanism that limits the depth of the electric motor. The rope has sections of increased diameter interposed between sections of decreased diameter, and wherein the locking mechanism comprises a slot of increased diameter such that the areas of the rope of increased diameter can pass, and a slot of decreased diameter such that areas of the rope of increased diameter cannot pass. One locking mechanism comprises a pulley over which the rope passes, and a ratchet mechanism that is spring biased engages the rope, wherein the ratchet mechanism is adapted to allow the rope to pass when the ratchet is released. Another type of cable is a chain. A chain locking mechanism comprises a large slot through which the chain links can pass, and a small slot through which the chain links cannot pass, and when the chain is engaged in the small slot the extension of the chain is limited.

The trolling motor further includes a mounting bracket that comprises a mounting plate for attachment to a boat, the mounting bracket including a mounting plate that is adapted to be secured to the trolling motor. The mounting plates include a hinging mechanism whereby when the telescoping drive shaft, in a vertical position, is completely retracted, and where further pulling of the cable causes the trolling motor to pivot about the mounting bracket into a horizontal stowage position.

DETAILED DESCRIPTION OF THE INVENTION

Figure 1:
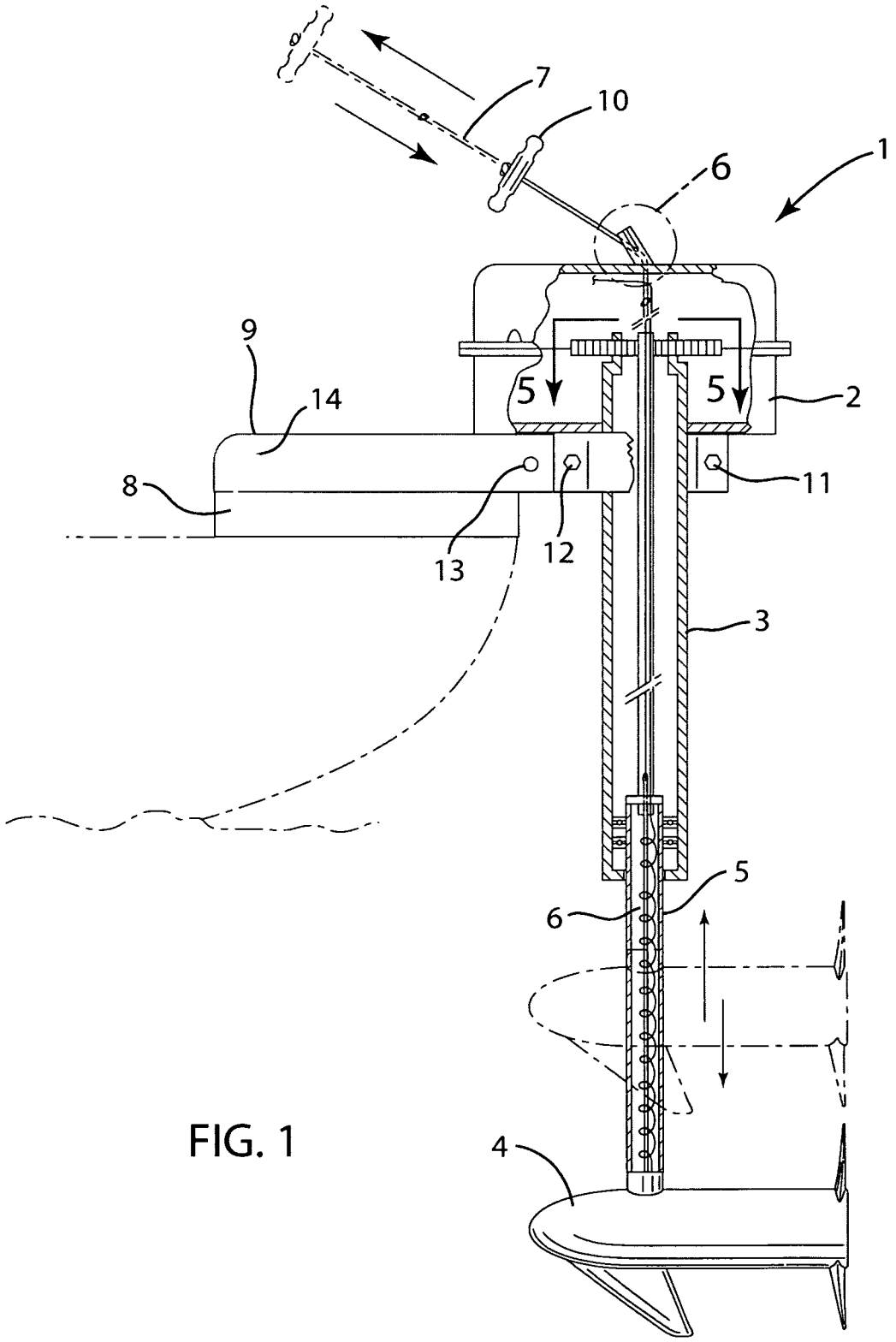
FIG. 1 shows a trolling motor according to the invention in the vertical, operating position.

The invention is best described in reference to the drawings. Referring to FIG. 1, trolling motor (1) is seen in its normal operating position. Trolling motor (1) includes upper shaft (3) interposed between drive head (2) and the electric motor (4). The electric motor includes a conventional keel and prop. The electric motor (4) is shown in its lower position in solid lines, and in its raised position in broken lines. Electric cable (6) is located within the outer, upper shaft section (3) and the lower, inner telescoping shaft section (5). Upon application of force to cable (7), using pull handle (10), the boat operator can raise or lower the electric motor by extending or retracting the telescoping shaft. The shaft (3) is clamped to the mounting bracket with hex nuts (11) and (12) using a clamp that surrounds the shaft. A plate (8) is secured to the deck of the boat, for instance with screws. Hinges (14) connect the clamp to mounting plate (8). Details of the hinged connection between the trolling motor and the mounting plate is best seen by reference to applicant's U.S. Pat. No. 7,163,427 and will not be further described herein for sake of brevity. Because the shaft telescopes, it is not necessary for the drive head (2) to extend above the mounting bracket in order to lower the depth of electric motor (4). The trolling motor head sits directly on and the mounting bracket. This affords significantly more overhead space on the deck of the boat when the trolling motor is in its vertical position over the prior art. A fisherman is also able to flip a lure without striking the trolling motor head, because the distance the head overlies the deck of the boat is considerably less than the conventional trolling motor that does not telescope.

Figure 2:
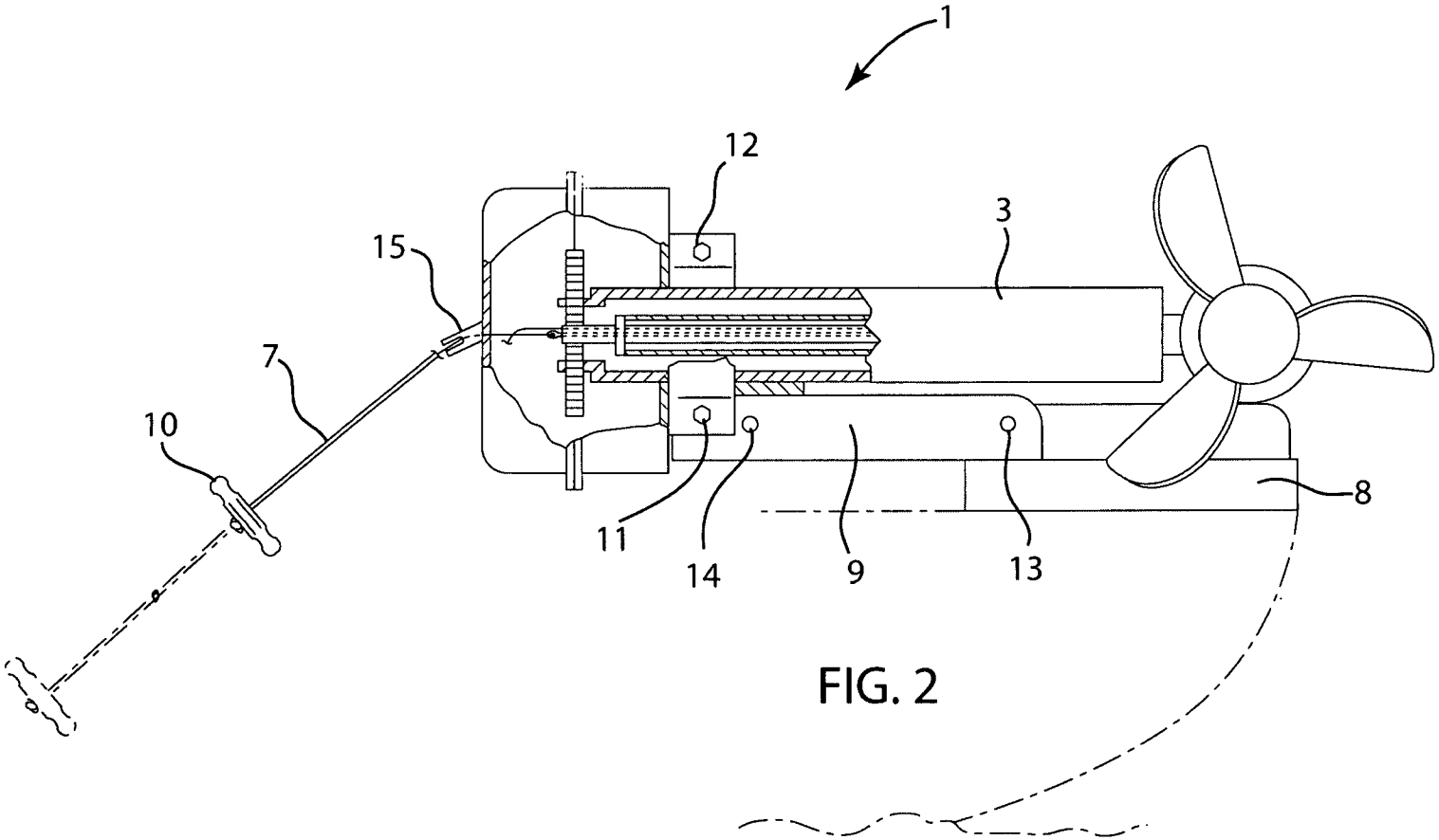
FIG. 2 shows the trolling motor of the present invention in stowage, horizontal position.

FIG. 2 shows trolling motor (1) in stowage position. Pull cord (7) has fully retracted the shaft, as seen in broken lines in FIG. 1. Continued tension in pull cord (7) after full retraction of the lower telescoping shaft causes rotation of the trolling motor about pivot points (13) and (14) of the mounting bracket. Trolling motor (1) is seen fully stowed. A cable securing mechanism (15) overlies the head (2) of the drive unit, and is attached thereto, to lock the trolling motor in the stowage position and to prevent unwanted extension of the telescoping shaft.

Figure 3:
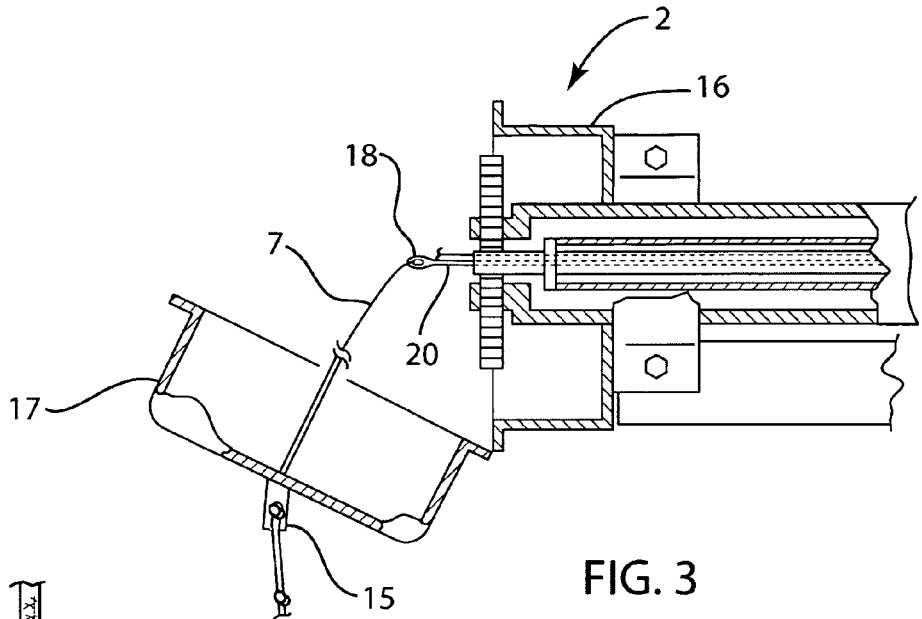
FIG. 3 shows the head of the instant trolling motor in section.

FIG. 3 shows drive unit head (2) in an open position, with halves (16) and (17) separated for maintenance. Cable (7) is secured to rod (20) for instance by tying. Rod (20) is connected to the electric motor. As shown, rod (20) extends slightly longer than lower telescoping shaft (5). It is contemplated that rod (20) could be any length that can be telescoped within shaft (5). Alternately, cable (7) could be attached directly to electric motor (4). A full length rod (20) as shown is preferred because it minimizes the effort to change a worn cable (7). Any suitable method of attaching cable (7) to the shaft is suitable, and the invention is not limited to any particular connection. It is important that the connection (18) be accessible to the operator, in order to replace a worn cable or to make other adjustments as are necessary.

Figure 4:
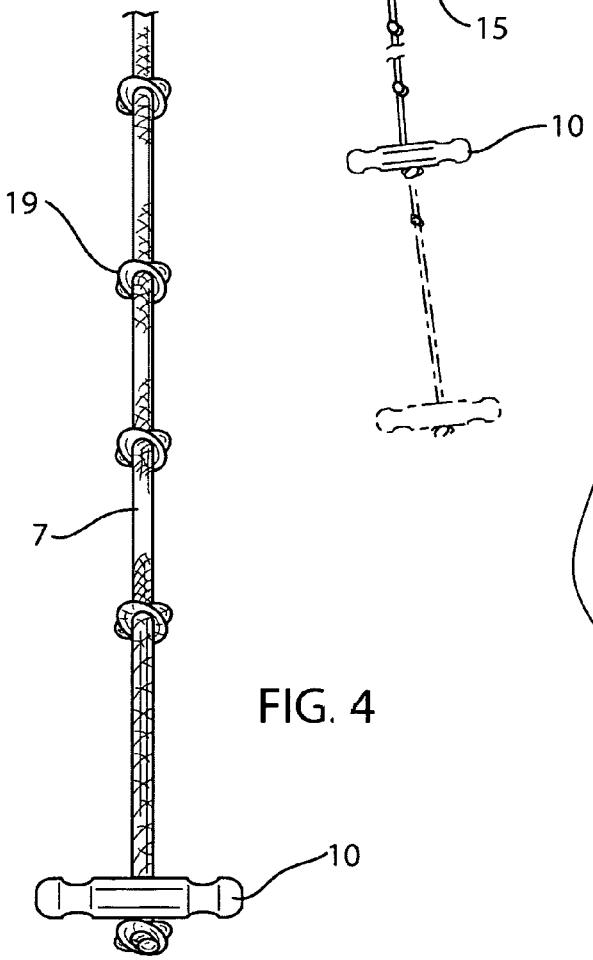
FIG. 4 shows a pull cord used to extend or retract the shaft, and to raise the trolling motor into stowage position.

FIG. 4 shows cable (7) in greater detail. Sections (19) where cable (7) has an increased diameter are regularly spaced along cable (7). The areas of increased diameter of cable (7) are intended to interact with a locking mechanism to prevent unwanted travel of cable (7).

Figure 5:
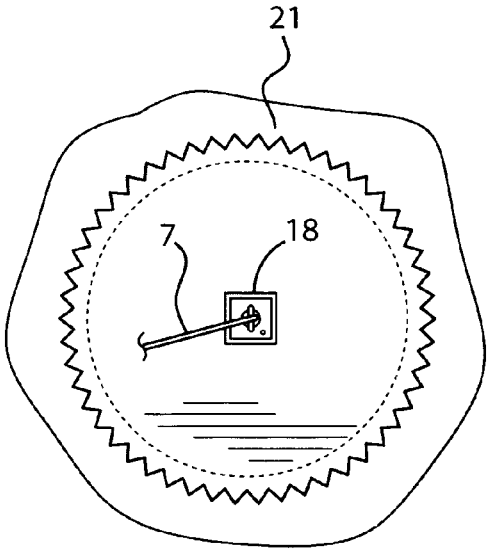
FIG. 5 shows the drive unit as seen in section across its axis of symmetry.

FIG. 5 shows the section view 5-5 from FIG. 1. Cable (7) is shown attached to the telescoping shaft through connection (18). Gear (21) is shown. Gear (21) is an element of a control mechanism to turn the shaft, such as when the boat is turned. The remote mechanism is best seen in applicant's U.S. Pat. No. 7,163,427, expressly incorporated herein.

Figure 6:
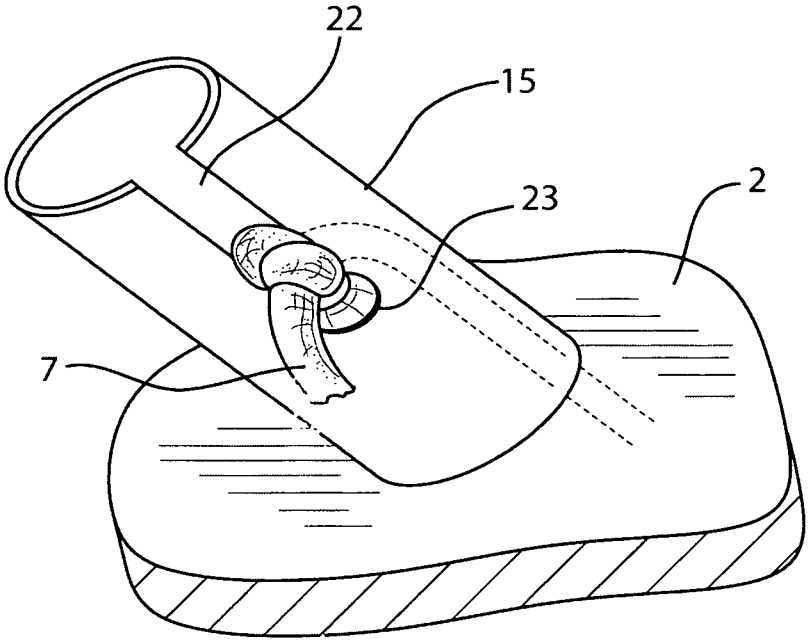
FIG. 6 shows a first embodiment of the cable locking mechanism according to the invention.

FIG. 6 shows greater detail of locking mechanism (15), located atop drive unit housing (2). Slot (22) has a decreased diameter from slot (23). Intermittent sections (19) of cable (7) of increased diameter can easily slide through slot (23), but cannot slide through slot (22). By pulling the cord (7) through slot (23), the drive shaft can be retracted. When the cord (7) is within slot (22), the cord is prevented from sliding. When it is desired to lower the trolling motor, and therefore lower the electric motor and prop depth, cable (7) is released through slot (23) and the trolling motor is lowered facilitated by the weight of the electric motor. When the desired depth is reached, the cable (7) is secured from further movement by locking the cable (7) in the smaller slot (22).

Figure 7:
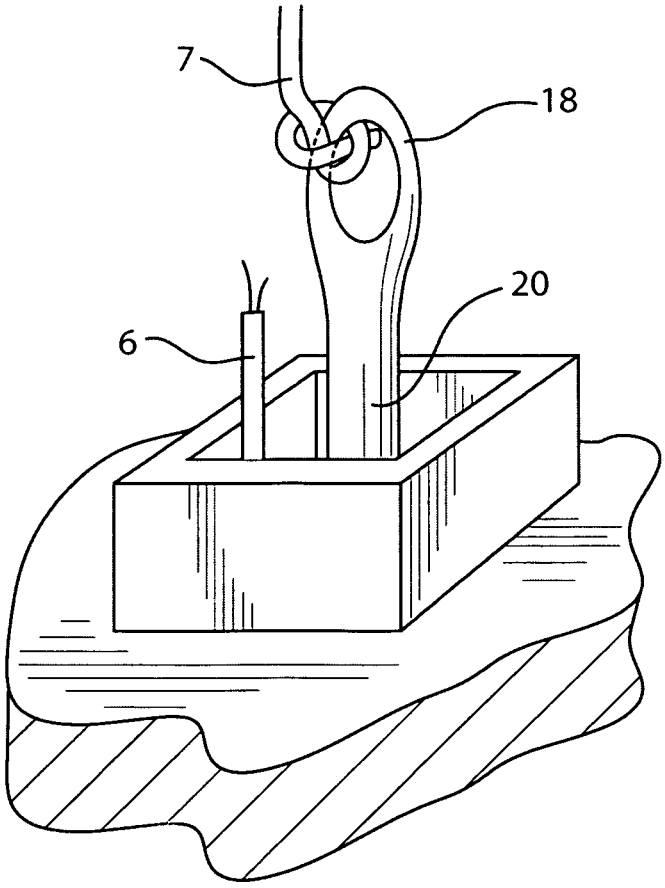
FIG. 7 shows a rod that connects the retraction cable to the electric motor, where the rod telescopes through a square steering tube.

FIG. 7 shows cable (7) tied to the top of rod (20) with knot (18). Electric cable (6), that supplies current to the electric motor (4), can been seen.

Figure 8:
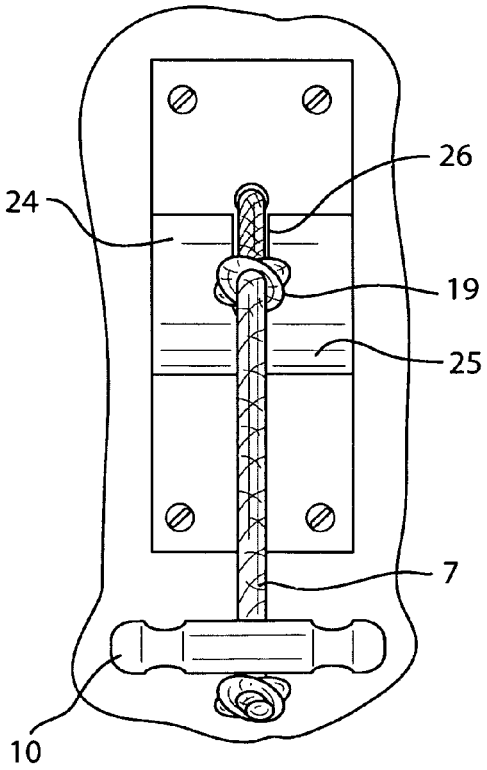
FIG. 8 shows a second embodiment of the cable locking mechanism according to the invention.

FIG. 8 shows another embodiment of the cable locking mechanism. Plate (24) protrudes above and is attached to head (2). Plate (24) has a larger slot (25) and a smaller slot (26). Enlarged sections of cable (7) can slide through slot (25) but not through slot (26). Slot (26) engages the larger sections of cable (7) to lock the cable and prevent the cable from being extended by gravity, or when the trolling motor is in stowage.

Figure 9:
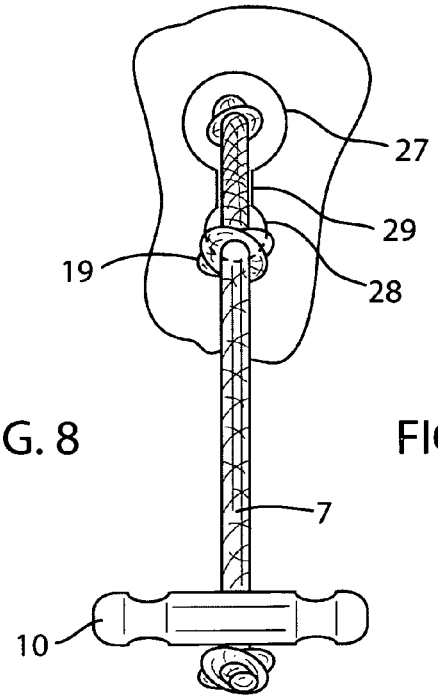
FIG. 9 shows a third embodiment of the cable locking mechanism according to the invention.

FIG. 9 shows another embodiment the cable securing mechanism. Here, smaller slot (26) is separated from larger slot (27) by means of intermediate slot (29). The enlarged sections (19) of cable (7) can easily slide through larger slots (27). The sections of cable (7) intermediate between the enlarges sections (19) can slide through intermediate slot (29), and into the smaller slot (26). In this manner, the cable length can be manipulated and locked at the desired length.

Figure 10:
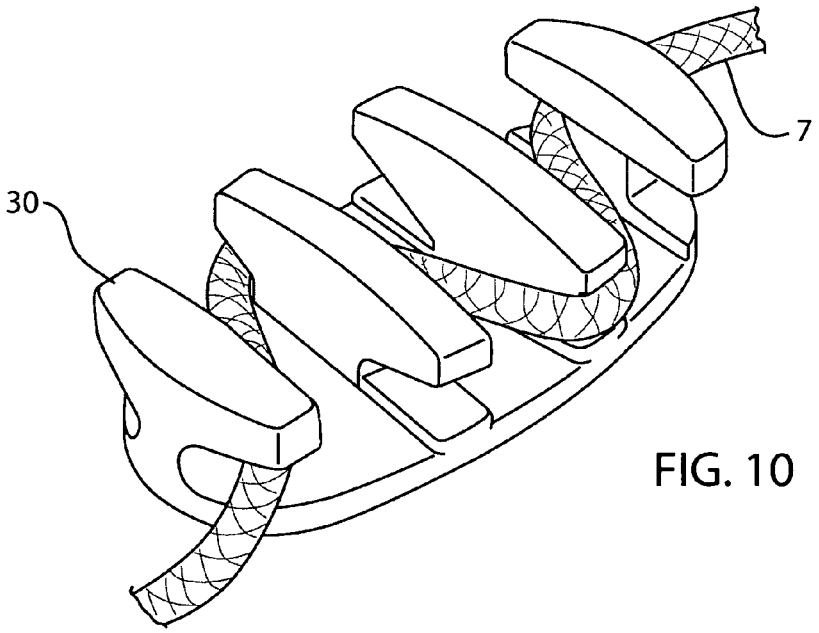
FIG. 10 shows a fourth embodiment of the cable locking mechanism according to the invention.

FIG. 10 shows another embodiment of the cable locking mechanism. Here, cable (7) serpentines through cleats (30). Cable (7) can be wrapped around any of the cleats (30), or tied. Alternatively cable (7) can be locked using any of the locks shown in FIG. 11, 12, or 13.

Figure 11:
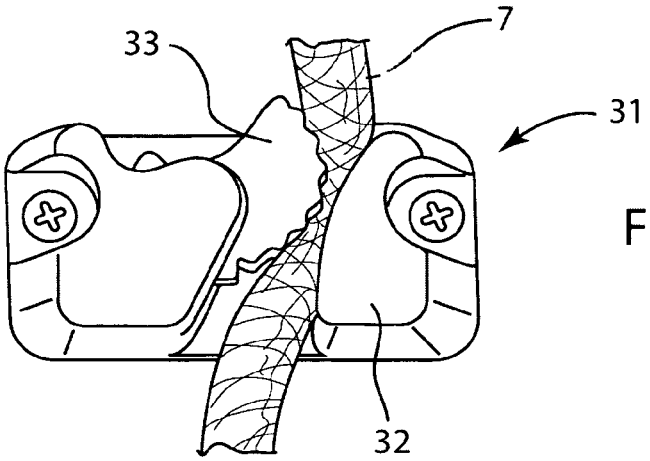
FIG. 11 shows a fifth embodiment of the cable locking mechanism according to the invention.

FIG. 11 shows a cable locking mechanism (31) that is conventionally used to secure lines on a boat or venetian blinds. When using the locking mechanism of FIGS. 11 and 13, no enlarged areas (19) of cable (7) are required, and an ordinary cable of constant diameter is used. Cable (7) slides through receiver (32), which has a concave surface that faces the cable (7). Ratchet (33) is spring loaded and biased to stop movement of cable (7). When the ratchet (33) is released, the cable (7) can slide therethrough.

Figure 12:
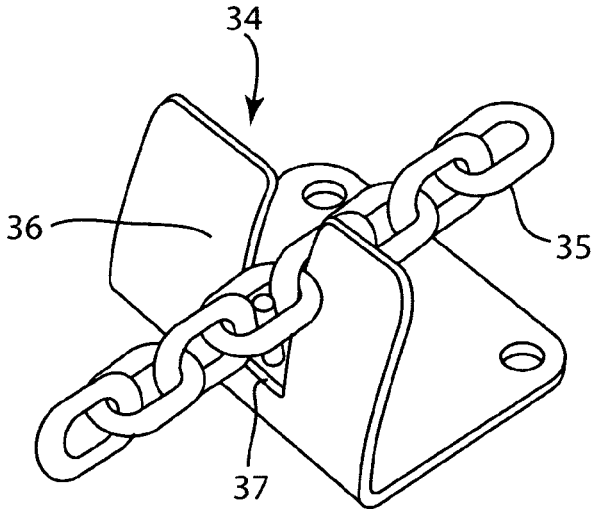
FIG. 12 shows a sixth locking mechanism according to the invention, adapted to lock a chain.

FIG. 12 shows a locking mechanism when a chain is used as an alternative to cable (7). Plate 34 is secured to the motor head, or to any convenient position on the boat or mounting bracket. Slot (36) is larger than slot (37) and affords sliding of chain (35) therethrough. When the chain is engaged in slot smaller (37), links of chain 35 cannot pass therethrough, locking the chain in the desired position.

Figure 13:
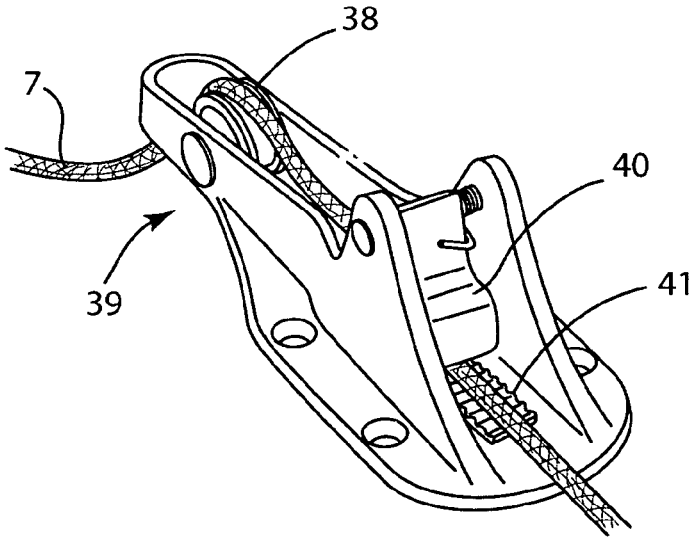
FIG. 13 shows a seventh embodiment of the cable locking mechanism according to the invention.

FIG. 13 is a conventional clamping mechanism (38) used for anchors, etc. in boats. Cable (7) passes over pulley (39) and through ratchet mechanism (40), (41). Ratchet (40) is spring loaded to prevent movement of cable (7) until the ratchet (40) is released by the operator. The locks comprise high-impact, rustproof and reinforced synthetic construction. A particularly preferred lock is sold as Deluxe Lift 'N' Lock™.

Figure 14:
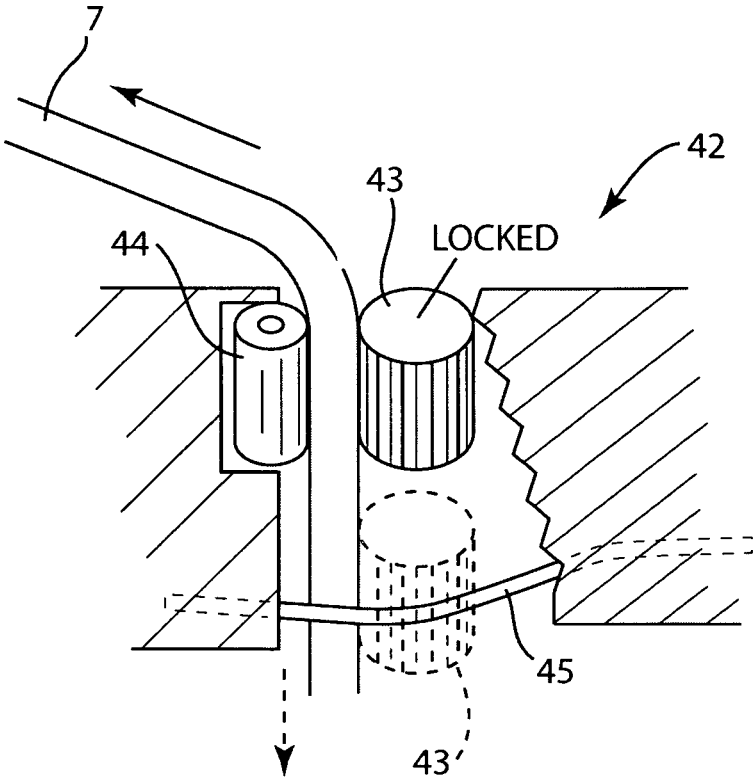
FIG. 14 shows an eighth embodiment of the cable locking mechanism according to the invention.

FIG. 14 shows yet another embodiment of the cable locking mechanism (42). Cable (7) passes across cylinder (44) when locking cylinder (43) is pushed away from cable (7). Spring (45) biases cylinder (43) in a locked position. When the cylinder (43) is pushed away, the cable (7) can be slid between cylinders (43) and (44). When the cable (7) is at the desired length, cylinder (43) is released and the cable (7) is locked. The surface of cylinder (43) can be grooved to facilitate holding the cable (7).

Figure 15:
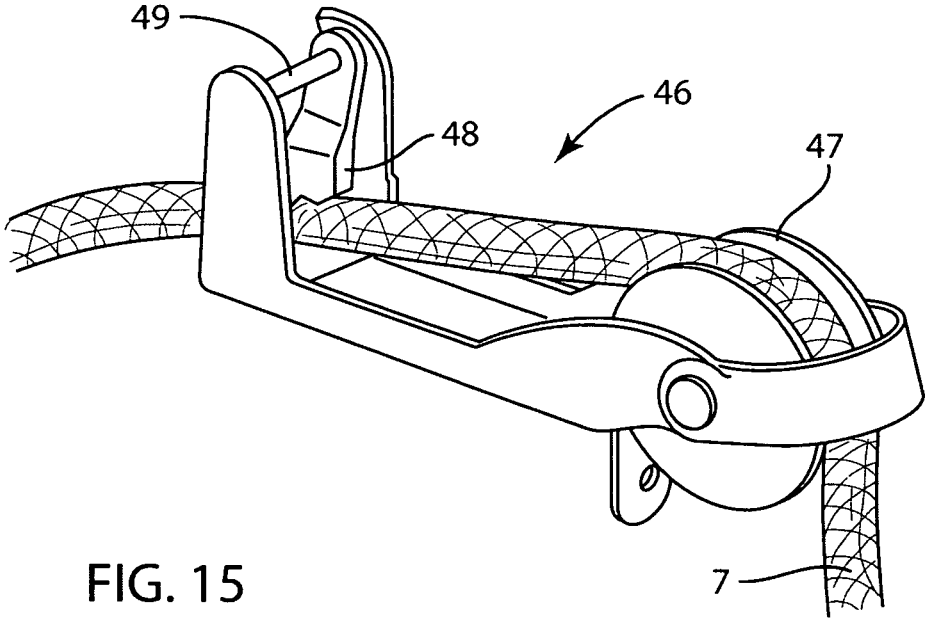
FIG. 15 shows a ninth embodiment of the cable locking mechanism according to the invention.

FIG. 15 is the final embodiment (46) for locking cable (7). Here, cable (7) passes over pulley (47) and through ratchet mechanism (48). Ratchet (48) rotates on shaft (49) and allows the cable (7) to be shortened. Ratchet (48) is spring loaded and biased to engage cable (7). When ratchet (48) is released, cable (7) can easily slide therethrough.

In use, the operator normally begins with the trolling motor in stowage position as seen in FIG. 2. The operator releases the cable (7) from its locking mechanism. The trolling motor is then pivoted into a working position, as seen in FIG. 1. The depth of the electric motor and prop are at a minimum after the trolling motor is pivoted into the vertical position, because the shaft is telescoped to a minimum length. Next the operator has the option to lower the depth of the electric motor by further releasing cable (7). The weight of the electric motor (4) will cause the shaft to extend without effort from the operator. When the shaft is extended to the desired length, corresponding to the desired depth of the electric motor and prop, the cable (7) is locked to prevent further extension.

Should the operator wish to raise the depth of electric motor (4), the operator simply unlocks cable (7) and shortens cable (7). A pulling force on cable (7) is transmitted to electric motor (4) through rod (20). When the electric motor (4) is at the appropriate depth, the cable (7) is locked. Continued pulling of cable (7) after the shaft is completely telescoped will cause the trolling motor to pivot from a vertical position to a horizontal stowage position. Therefore, the operator can both raise the depth of the electric motor (4) and pivot the trolling motor into stowage position with a single cable.

The invention claimed is:

1. A trolling motor comprising a drive unit that includes a drive head, an electric motor with prop, and a telescoping shaft with an upper, outer shaft and a lower, inner shaft, wherein the inner shaft is nested within the outer shaft, and slidingly rides on a hollow steering tube fixed to and inside the outer shaft where the telescoping shaft is interposed between the drive head and the electric motor, the inner shaft being attached to the electric motor, further including a first cable attached to one end of a rod extending through the inner shaft and also through the hollow steering tube when the telescoping shaft is fully retracted and where an opposite end of the rod attaches to the electric motor, such that pulling the first cable raises the electric motor and collapses the telescoping shaft, and such that releasing the first cable lowers the electric motor and extends the telescoping shaft, and an electric cable extending through the telescoping shaft and drive head, and adapted to carry electric current to the electric motor.

2. The trolling motor of claim 1 wherein the first cable adapted to extend or retract the telescoping shaft is a rope with a locking mechanism that limits the depth of the electric motor.

3. The trolling motor of claim 2 wherein the rope has sections of increased diameter interposed between sections of decreased diameter, and wherein the locking mechanism comprises a slot of increased diameter such that the areas of the rope of increased diameter can pass, and a slot of decreased diameter such that areas of the rope of increased diameter cannot pass.

4. The trolling motor of claim 2 wherein the locking mechanism comprises a pulley over which the rope passes, and a ratchet mechanism that is spring biased to engage the rope, wherein the ratchet mechanism is adapted to allow the rope to pass when the ratchet mechanism is released.

5. The trolling motor of claim 1 wherein the first cable is a chain with links and a chain locking mechanism comprises a large slot through which the chain links can pass, and a small slot through which the chain links cannot pass, and when the chain is engaged in the small slot the extension of the chain is limited.

6. The trolling motor of claim 1 further including a mounting bracket that comprises a first mounting plate for attachment to a boat, the mounting bracket including a second mounting plate that is adapted to be secured to the trolling motor, the first and second mounting plates including a hinging mechanism whereby when the telescoping shaft, in a vertical position, is completely retracted, further pulling of the first cable causes the trolling motor to pivot about the mounting bracket into a horizontal stowage position.

7. A trolling motor comprising a drive unit that includes a drive head, an electric motor with prop, and a telescoping shaft with an upper, outer shaft and a lower, inner shaft, wherein the inner shaft is nested within the outer shaft, and slidingly rides on a hollow steering tube fixed to and inside the outer shaft, where the telescoping shaft is interposed between the drive head and the electric motor, the inner shaft being attached to the electric motor, further including a first cable attached to one end of a rod extending through the inner shaft, the one end of the rod extending through the hollow steering tube when the telescoping shaft is fully retracted and where an opposite end of the rod attaches to the electric motor, such that pulling the first cable raises the electric motor and collapses the telescoping shaft, and such that releasing the first cable lowers the electric motor and extends the telescoping shaft, and an electric cable extending through the telescoping shaft and drive head, and adapted to carry electric current to the electric motor, the drive head having an upper housing removable from a lower housing to permit access to the first cable attached to one end of the rod when the telescoping shaft is fully retracted.

8. A trolling motor comprising a drive unit that includes a drive head, an electric motor with prop, and a telescoping shaft with an upper, outer shaft and a lower, inner shaft, wherein the inner shaft is nested within the outer shaft, and slidingly rides on a hollow steering tube fixed to and inside the outer shaft, where the telescoping shaft is interposed between the drive head and the electric motor, the inner shaft being attached to the electric motor, further including a first cable attached to one end of a rod extending through the inner shaft, the one end of the rod also extending through the hollow steering tube when the telescoping shaft is fully retracted and where an opposite end of the rod attaches to the electric motor, such that pulling the first cable raises the electric motor and collapses the telescoping shaft, and such that releasing the first cable lowers the electric motor and extends the telescoping shaft, and an electric cable extending through the telescoping shaft and drive head, and adapted to carry electric current to the electric motor, a clamping mechanism mounted adjacent a bottom of the drive head to support the drive head, the clamping mechanism also clamping the upper shaft of the telescoping shaft directly beneath the bottom of the drive head, the clamping mechanism adapted to be mounted to a mounting bracket for securing the trolling motor to a boat.

9. The trolling motor of claim 8 wherein the mounting bracket further including a first mounting plate that is adapted to be secured a boat, the mounting bracket including a second mounting plate that is adapted to be secured to the trolling motor, the first and second mounting plates including a hinging mechanism whereby when the telescoping drive shaft, in a vertical position, is completely retracted, further pulling of the first cable causes the trolling motor to pivot about the mounting bracket into a stowage position.

* * * * *